US009016204B2

(12) United States Patent
Odintsov

(10) Patent No.: US 9,016,204 B2
(45) Date of Patent: Apr. 28, 2015

(54) FRAGMENTATION-BEAM TANK PROJECTILE

(75) Inventor: Vladimir Alekseevich Odintsov, Moscow (RU)

(73) Assignees: Federal State Budgetary Educational Institution of Higher Professional Education (Bauman Moscow State Technical University), Moscow (RU); Federal State Budgetary Institution (Federal Agency for Legal Protection of Military, Special and Dual Use Intellectual Activity Results), Moscow (RU)

( * ) Notice: Subject to any disclaimer, the term of this patent is extended or adjusted under 35 U.S.C. 154(b) by 0 days.

(21) Appl. No.: 14/360,939

(22) PCT Filed: Aug. 9, 2012

(86) PCT No.: PCT/RU2012/000653
§ 371 (c)(1),
(2), (4) Date: May 28, 2014

(87) PCT Pub. No.: WO2013/081492
PCT Pub. Date: Jun. 6, 2013

(65) Prior Publication Data

US 2014/0299012 A1 Oct. 9, 2014

(30) Foreign Application Priority Data

Nov. 28, 2011 (RU) ..... 2011148107

(51) Int. Cl.

| | |
|---|---|
| ***F42B 12/22*** | (2006.01) |
| ***F42B 12/28*** | (2006.01) |
| ***F42B 12/32*** | (2006.01) |
| ***F42B 10/14*** | (2006.01) |
| ***F42B 12/24*** | (2006.01) |
| ***F42B 10/02*** | (2006.01) |

(52) U.S. Cl.
CPC ..... *F42B 12/28* (2013.01); *F42B 12/32* (2013.01); *F42B 10/14* (2013.01); *F42B 12/24* (2013.01); *F42B 10/02* (2013.01); *F42B 12/22* (2013.01)

(58) Field of Classification Search
CPC ..... F42B 12/22; F42B 12/32
USPC ..... 102/491, 492, 494, 496, 497
See application file for complete search history.

(56) References Cited

U.S. PATENT DOCUMENTS

| | | | | |
|---|---|---|---|---|
| 4,658,727 | A * | 4/1987 | Wilhelm et al. | 102/494 |
| 7,451,704 | B1 * | 11/2008 | Gold et al. | 102/495 |
| 8,528,480 | B2 * | 9/2013 | Seidel et al. | 102/492 |
| 2006/0283347 | A1 | 12/2006 | Lloyd | |

FOREIGN PATENT DOCUMENTS

| | | |
|---|---|---|
| EP | 0747660 | 12/1996 |
| RU | 2327948 | 6/2008 |
| WO | WO 2013/081492 | 6/2013 |

OTHER PUBLICATIONS

International Search Report Dated Jan. 17, 2013 From the International Searching Authority of the Russian Federation Re. Application No. PCT/RU2012/000653.

* cited by examiner

*Primary Examiner* — Reginald Tillman, Jr.

(57) ABSTRACT

This invention relates to fragmentation-beam ammunition capable of simultaneous axial and circular field destruction. The objects of this invention are providing a variable configuration axial field of the fabricated destructive elements for the reliable destruction of different types of tank threatening targets and providing for the complete destruction of the fragmentation unit following explosive charge detonation in the projectile.

The technical solution according to this invention, the projectile comprises an elongated explosive charge with a detonator in the form of a rotation body with a curvilinear generatrix located coaxially with the fragmentation unit wherein said detonator is electrically connected with the fuse and said fuse comprises a device (an adapter booster) for varying the time interval between the activation of both detonators depending on the setting, said detonators comprising safety devices.

18 Claims, 4 Drawing Sheets

FRAGMENTATION-BEAM TANK PROJECTILE

RELATED APPLICATIONS

This application is a National Phase of PCT patent application No. PCT/RU2012/000653 having International filing date of Aug. 9, 2012, which claims the benefit of Russian Federation Patent Application No. 2011148107 filed on Nov. 28, 2011. The contents of the above applications are all incorporated by reference as if fully set forth herein in their entirety.

FIELD OF THE INVENTION

This invention relates to fragmentation beam ammunition capable of simultaneous axial and circular fields of injury.

BACKGROUND OF THE INVENTION

Known is a fragmentation-beam projectile comprising a casing with a monolithic head section having an axial channel, an explosive charge with a detonator located in the middle section of the charge, a head section trajectory-contact fuse electrically connected to the detonator, a fragmentation unit located between the casing and the fuse and externally enveloping the projectile head section, and a screw-in bottom with stabilizing fins (RU 2327948, publ. Jun. 27, 2008).

Said composite fragmentation unit comprises fabricated destructive elements in a binder matrix.

The main disadvantage of said known projectile is the fixed axial field shape of the fabricated destructive elements which does not ensure reliable destruction of tank threatening targets of different classes (single, grouped including groups of different configurations, ground, air etc.). Another disadvantage is the possibility of incomplete destruction of the fragmentation unit following explosive charge detonation in the projectile. Yet another disadvantage is the large diameter of the axial channel in the charge necessitated by the installation of a detonator with a safety device and reducing the strength of the projectile casing head section.

The object of this invention is to provide a projectile while eliminating the above disadvantages.

DISCLOSURE OF THE INVENTION

The technical result of this invention is providing an improved efficiency of target destruction.

In accordance with the technical result of this invention, the projectile comprises an elongated explosive charge with a detonator located coaxially with the fragmentation unit wherein said detonator is electrically connected with the fuse and said fuse comprises a device (an adapter booster) for varying the time interval between the activation of both detonators depending on the setting, said detonators comprising safety devices.

BRIEF DESCRIPTION OF THE DRAWINGS

This invention will now be illustrated with the drawings hereinbelow.

Figure 1:
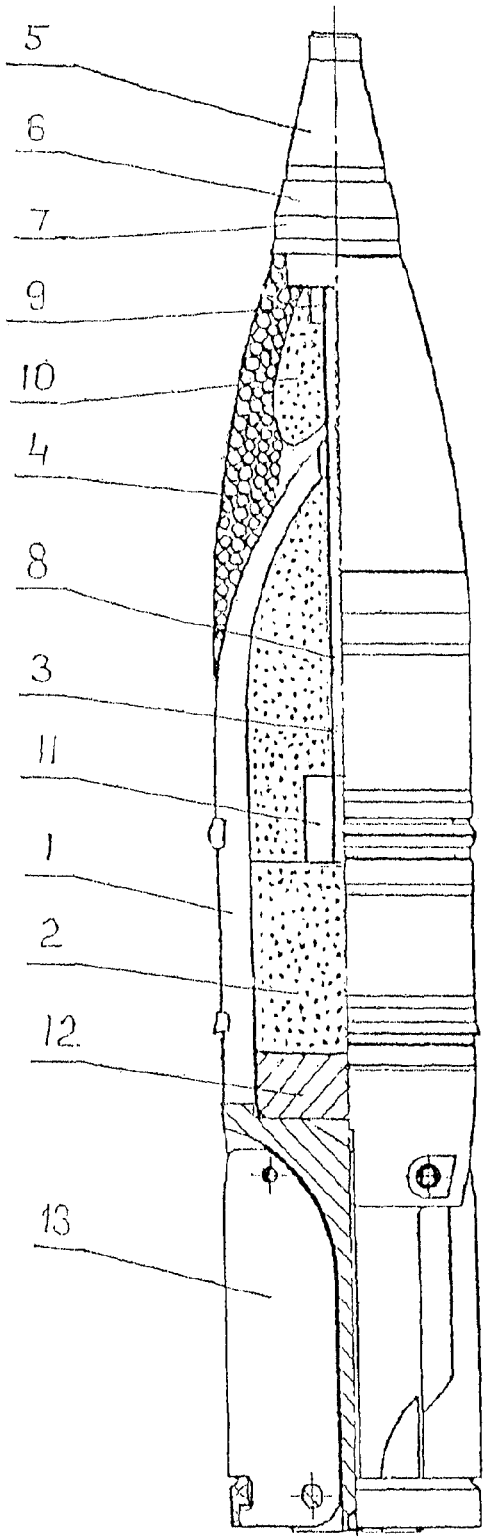
FIG. 1 is the smooth-bore tank gun projectile schematic.

The projectile comprises the casing 1 with a monolithic conical or ogival head section filled with the composite explosive charge 2. The head section has the small-diameter axial channel 3. Adjacent to the projectile head section is the fragmentation unit 4 with the electronic trajectory-contact fuse 5. The fuse comprises the head contact unit 6 and the settings receiver device 7. The multi-cored electrical conductor 8 connects the fuse 5 with the detonator-safety device unit 9 of the fragmentation unit explosive charge 10 and the projectile charge detonator 11. The detonator 11 is located in the head section of the projectile explosive charge 2 and is flush with its rear surface. The rear projectile section has the screw-in bottom 12 with the stabilizing fins 13 attached thereto.

The fragmentation unit 4 is a composite structure comprising fabricated destructive elements fabricated of steel or tungsten base heavy alloys and a binder matrix e.g. cold cured epoxy compound. The fabricated destructive elements can have a shape allowing their tight packing. One possible embodiment is the use of metallic powder as the binder (powder pressing technology of the fragmentation unit).

Also possible is fragmentation unit embodiment in the form of a predesigned disintegration unit. The whole-bodied unit can be fabricated by sequentially coating the projectile surface with molten metal drops formed by exposing an electrode inserted into the melting zone to a laser or electron beam (V. A. Odintsov, Fragmentation-Beam Tank Projectiles with Additional Penetration and High-Explosive Capability. Defense Engineering, 2010, No. 3).

Figure 2:
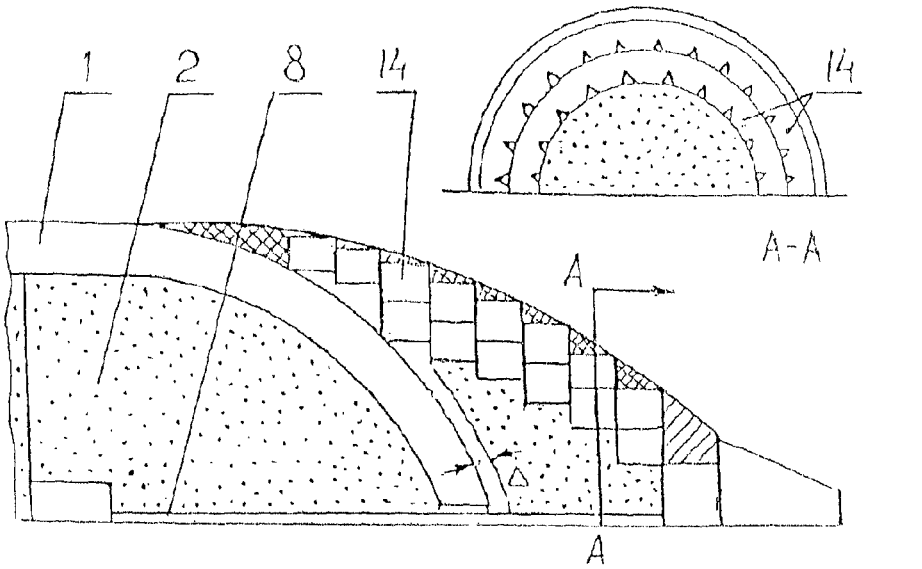
FIGS. 2&3 are fragmentation unit embodiments.
Figure 3:
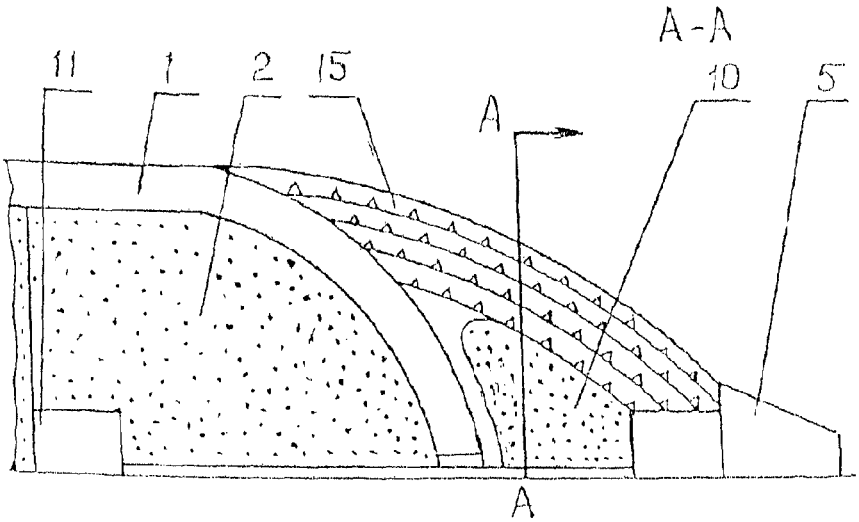

FIG. 2 shows fragmentation unit embodiment in the form of a set of shear rings 14 (V. A. Odintsov, Fragmentation Ammunition Design (Training Aid). Part I. N. E. Bauman MGTU, 2002), and FIG. 3 shows fragmentation unit embodiment in the form of a set of nested rifled casings 15.

The fragmentation unit should satisfy two competitive requirements:

- withstand shot-induced overloads without destruction;
- completely disintegrate into fabricated destructive elements upon projectile explosion.

The choice of size ensuring sufficient fragmentation unit strength is discussed elsewhere (RU 2327948, publ. Jun. 27, 2008).

A gap with the dimension Δ filled with an inert and easily compressible material is provided between the fragmentation unit charge 10 and the casing 1. The gap dimension calculated based on the admissible impact of fragmentation unit charge explosion on the projectile casing is 6-8 mm.

Possible subcaliber projectile embodiment (FIG. 4) is considered. The projectile has the detachable composite tray 16 attached to the subcaliber projectile casing through the ring-shaped rifling 17. The projectile has low weight, high muzzle velocity, shorter target reach time and hence higher firing precision.

EMBODIMENTS OF THE INVENTION

Projectile Functioning

The projectile is programmable and provides the following functionality depending on the settings:

- trajectory explosion (destruction) during target approach (at a prediction point);
- ground impact explosion with preset instantaneous (fragmentation) action;
- ground impact explosion with preset fragmentation/high-explosive action (low deceleration);
- ground impact explosion with preset penetration/high-explosive action (high deceleration).

Before the shot the tank fire control system determines target type, distance, azimuth relative to the tank, target configuration for grouped targets and the required fuse settings.

For trajectory destruction the tank's fire control electronics calculates the flight to destruction time, the destruction height, the optimum projectile and fragmentation unit charge explosion time interval and the gun firing elevation.

Fuse settings are contact or contactless entered into the fuse through the settings receiver device 7.

For trajectory destruction the axial field and the meridian beam angle distribution of the fabricated destructive elements depend on the preset time interval between the explosions of the two charges.

Figure 5:
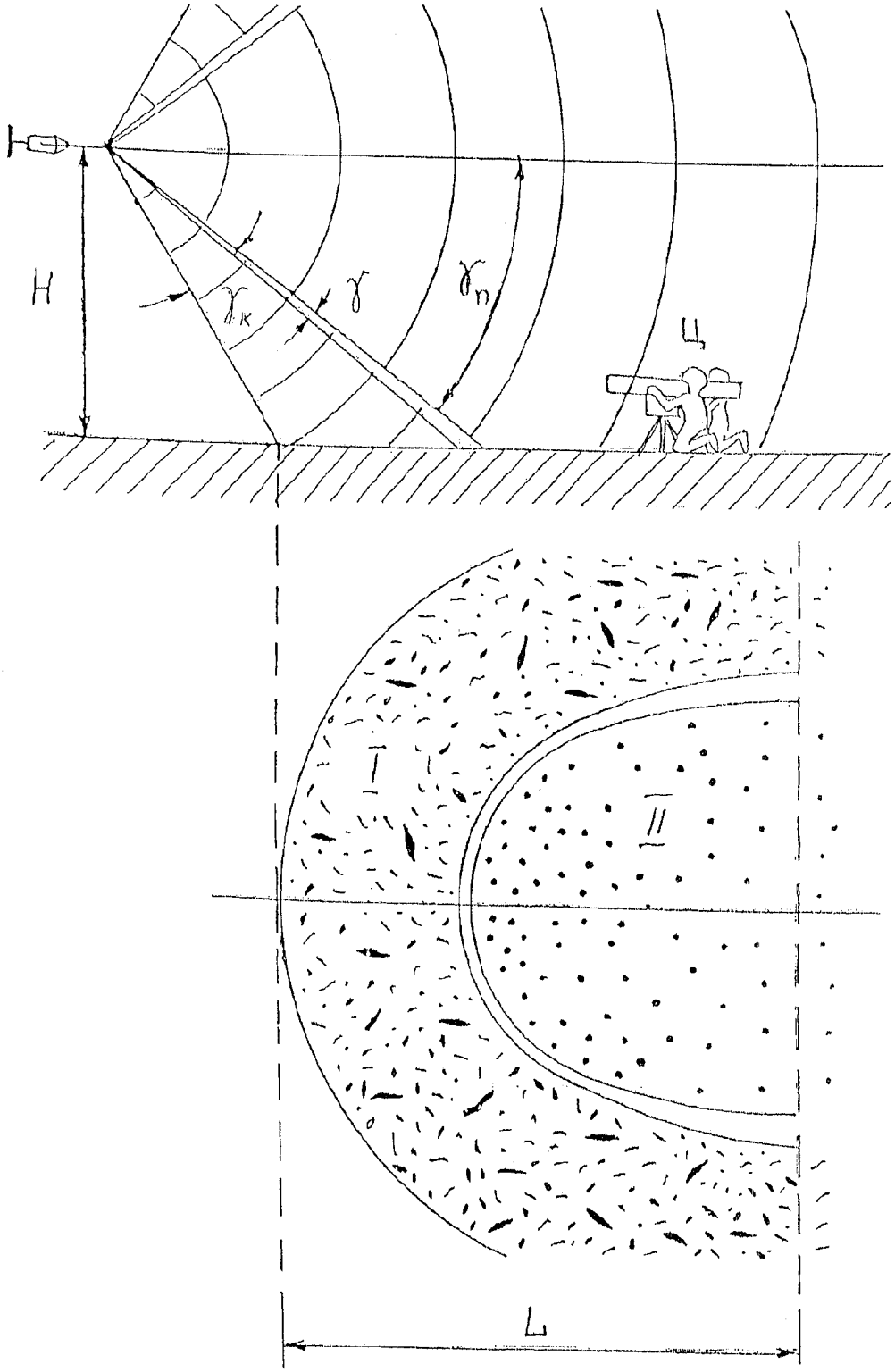
FIG. 5 is the projectile functioning schematic.

The projectile charge detonator location in the middle section of the charge increases the meridian emission angle $\Psi_c$ of natural casing fragmentation particles (FIG. 5). The choice of the fragmentation unit elongated charge configuration in the form of a rotation body with a curvilinear generatrix provides for a uniform distribution of the fabricated destructive elements in the transverse section of the axial field (the beam) with the dynamic meridian angle $\Psi_b$.

Correct choice of the projectile head section components and the time interval between the explosions of the two charges provides for a close to zero "dead" angle between the two fields, i.e. the local damage zones (zone I developed by the radial field of the projectile natural fragmentation particles and zone II developed by the fabricated destructive elements of the axial beam) should be "patched".

The condition of ground target T coverage by the joint field at the projectile explosion height H is expressed as $L>6\sigma_z$, where $\sigma_z$ is the RMS deviation of the explosion point from the design position.

For large air targets, primarily, antiarmor helicopters, the optimum projectile destruction distance and the time interval between the explosions of the two charges are set taking into account the coordinates and projections sizes of equally vulnerable target components on the projection plane. The latter are determined by the tank fire control system before the shot.

For firing with impact action fuse setting, special attention is paid to the destruction of strong (concrete and brickwork) walls for which the fuse is set to large deceleration (penetration and high-explosive action) because it is this setting that provides for successful tank self-defense in urban battle conditions. The projectile strength at the concrete impact moment is provided by its whole-head design and the small axial channel diameter. Strong obstacles are typically destructed with the fragmentation unit safety device activated to prevent the fragmentation unit charge from exploding upon impacting the obstacle. The impact causes destruction of the fragmentation unit followed by partial penetration of the fabricated destructive elements to beyond the obstacle. This largely increases the after-penetration effect of the projectile.

Figure 4:
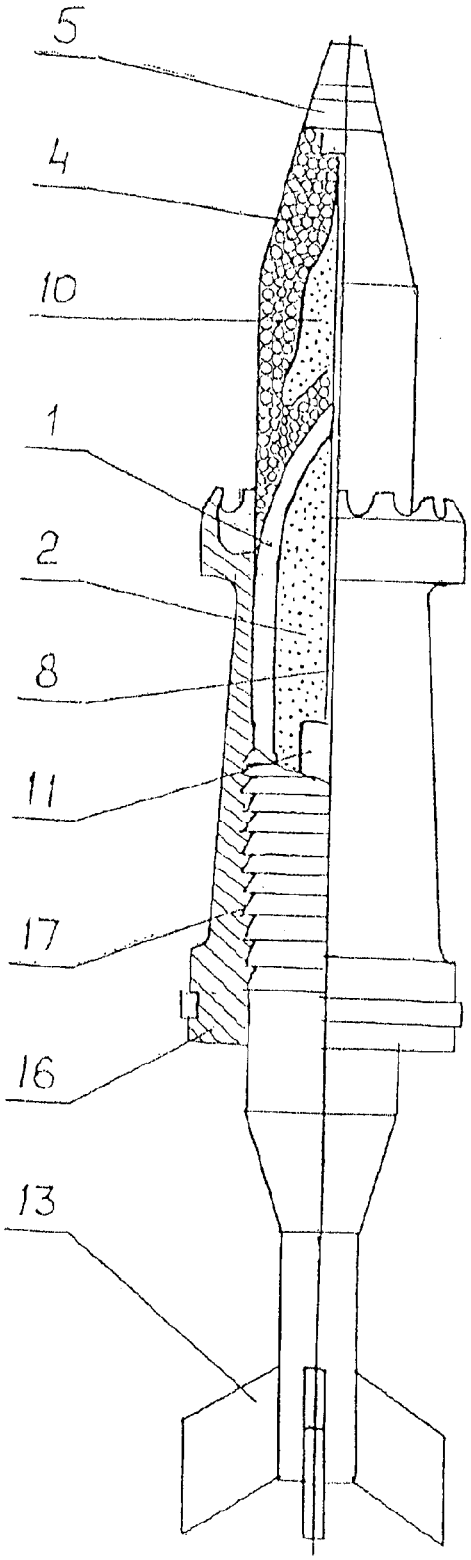
FIG. 4 is the subcaliber projectile embodiment.

The subcaliber projectile as depicted in FIG. 4 has a higher initial velocity (1300-1400 mps) due to the lower weight. Following the departure from the bore channel the tray sectors diverge to expose the subcaliber casing. The high projectile velocity reduces the target reach time and hence increases firing precision.

The use of two-component fragmentation unit with low weight of fine sized fabricated destructive elements (0.1-0.3 g), while providing for the destruction of a wide range of targets, also provides for the reliable destruction of tank threatening personnel located within the front projectile emission hemisphere.

The truncated cone shaped intermediate section provided between the cylindrical projectile section and the stabilizing fins improves projectile flowaround and reduces its bottom impedance. Impedance is further reduced by the smaller span of the rigid stabilizing fins. This reduces trajectory velocity loss.

Also considered is fragmentation unit charge embodiment comprising a pyrotechnical charge wherein the detonator is replaced for an igniter.

What is claimed is a:

1. Fragmentation-beam projectile comprising a casing with a monolithic head section having an axial channel, first explosive charge with a first detonator located in the middle section of the first explosive charge, a head section trajectory-contact fuse electrically connected to the first detonator, a fragmentation unit located between the casing and the fuse and externally enveloping the projectile head section, and a screw-in bottom with stabilizing fins, wherein said projectile comprises a second explosive charge with a second detonator located coaxially with the fragmentation unit, said second detonator is electrically connected with the fuse and said fuse comprises a setting receiver device that is an adapter booster for varying the time interval between the activation of both first and second detonators depending on the setting.

2. Projectile of claim 1 wherein the second explosive charge is in the form of a rotation body with a curvilinear generatrix.

3. Projectile of claim 1 wherein the second explosive charge has an axial channel.

4. Projectile of claim 1 wherein the first explosive charge is composite and the first detonator is located in the head section of the first explosive charge and is flush with its rear surface.

5. Projectile of claim 1 wherein said fragmentation unit is a composite structure comprising fabricated destructive elements fabricated of steel or tungsten base heavy alloys and a binder matrix.

6. Projectile of claim 5 wherein said fabricated destructive elements have a shape allowing their tight packing.

7. Projectile of claim 5 wherein the binder matrix is metallic powder and the fragmentation unit is fabricated using the powder pressing technology.

8. Projectile of claim 1 wherein said fragmentation unit is in the form of a set of shear rings.

9. Projectile of claim 1 wherein said fragmentation unit is in the form of a set of nested rifled casings.

10. Projectile of claim 1 wherein the second explosive charge comprises a pyrotechnical charge wherein the second detonator is replaced for an igniter.

11. Projectile of claim 1 wherein a gap filled with an inert and easily compressible material is provided between the second explosive charge and the casing, the gap dimension being 6-8 mm.

12. Projectile of claim 1 wherein said head section fuse has three settings for different types of impact action:

instantaneous (fragmentation action);

low deceleration (fragmentation/high-explosive action); and high deceleration (penetration/high-explosive action).

13. Projectile of claim 1 wherein both the first and the second detonators have safety devices.

14. Projectile of claim 1 wherein said projectile is subcaliber and has a detachable composite tray.

15. Projectile of claim 1 wherein said fragmentation unit has two-components of fabricated destructive elements.

16. Projectile of claim 15 wherein the fabricated destructive elements comprise 0.1-0.3 g fabricated destructive elements.

17. Projectile of claim 5 wherein the fragmentation unit has two-components of fabricated destructive elements.

18. Projectile of claim 17 wherein the fabricated destructive elements comprise 0.1-0.3 g fabricated destructive elements.

* * * * *